United States Patent [19]

Perineau et al.

[11] Patent Number: 4,940,524

[45] Date of Patent: Jul. 10, 1990

[54] ELECTROACTIVATED CATHODE MATERIALS

[75] Inventors: Jean-Maurice Perineau, Villiers Sur Marne; Jean Bachot, Bourg La Reine, both of France

[73] Assignee: Rhone-Poulenc Chimie, Courbevoie, France

[21] Appl. No.: 208,503

[22] Filed: Jun. 20, 1988

[30] Foreign Application Priority Data

Jun. 19, 1987 [FR] France ..... 87 08842

[51] Int. Cl.[5] ..... C25B 11/04

[52] U.S. Cl. ..... 204/242; 204/282; 204/283; 204/284; 204/291; 204/292; 204/293; 204/279; 428/332; 428/288; 428/290; 428/367; 428/402; 427/77; 427/243; 502/101; 502/159; 502/301; 264/109; 264/238

[58] Field of Search ..... 427/94, 77, 243, 247, 427/301; 502/101, 159; 428/332, 357, 367, 402, 288, 290; 204/283, 284, 282, 290 R, 279, 291, 292, 293, 242; 264/109, 238

[56] References Cited

U.S. PATENT DOCUMENTS

| | | | |
|---|---|---|---|
| 4,301,218 | 11/1981 | Benczur-ürm/össy | 204/294 |
| 4,554,063 | 11/1985 | Braun et al. | 204/294 |
| 4,737,257 | 4/1988 | Boulton | 204/292 |
| 4,743,349 | 5/1988 | Bachot et al. | 204/290 R |

*Primary Examiner*—John F. Niebling
*Assistant Examiner*—Kathryn Gorgos
*Attorney, Agent, or Firm*—Burns, Doane, Swecker & Mathis

[57] ABSTRACT

Disclosed are electroactivated shaped articles, well adapted as cathode elements and composites, especially for electrolytic cells for the electrolysis of sodium chloride. The articles include a mass of fibrous material consolidated in a matrix of fluoropolymer binder wherein at least a portion of the fibers are electrically conductive. The shaped articles have a resistivity of less than 0.4 ohm cm, and have at least one electrocatalytically active agent uniformly dispersed therethrough. The electrocatalytically active agent(s) is (are) selected from Raney metals or Raney alloys depleted in fugitive metal values.

22 Claims, No Drawings

ELECTROACTIVATED CATHODE MATERIALS

BACKGROUND OF THE INVENTION

1. Field of the Invention:

The present invention relates to an electroactivated material suitable for the production of the cathode element of an electrolysis cell, and, more especially, of a cell for the electrolysis of aqueous solutions of alkali metal halides. This invention also relates to such cathode element, per se, and to a process for the production of said materials and cathode elements.

The subject electroactivated materials exhibit a low overvoltage with respect to the hydrogen release reaction at the cathode and consequently permit considerable energy savings.

2. Description of the Prior Art:

In published European Patent Application EP-A-0,132,425 (corresponding to U.S. Pat. No. 4,743,349), a material is described comprising fibers and a binder suitable for producing the cathode element of an electrolysis cell, said material being characterized in that at least a part of the fibers consists of electrically conductive fibers, in that the binder is selected from among the fluoropolymers and in that the resistivity of said material is below 0.4 ohm cm and preferably below 0.1 ohm cm.

The conductive fibers may be carbon fibers and nonconductive fibers, such as asbestos fibers also constitute the described material.

Such prior art material may additionally contain one or more electrocatalytic agents which may be present in the form of powder with a particle size of from 1 to 10 microns. Platinum, palladium, and the nickel-zinc, nickel-aluminum, titanium-nickel, molybdenum-nickel, sulfur-nickel, nickel-phosphorus, cobalt-molybdenum and lanthanum-nickel alloys and couples are among the electrocatalytic agents intended.

In this '425 application, the quantity of electrocatalytic agent could represent up to 50% by weight of the bonded sheet, a content of between 1 and 30% of the said weight being recommended.

However, all of the materials according to this '425 application, although being electroactivated, exhibit at least one of the following disadvantages:

(1) resorting to nonconductive fibers which have been made conductive by metallizing, such as nickel-coated asbestos fibers, or nickel-coated carbon fibers, is not only costly—and this restricts development on an industrial scale—but would be incapable of replacing the electrocatalytic agent when considered strictly from the standpoint of efficiency; furthermore, these fibers can be altered by heat treatments;

(2) resorting to electrochemical deposition, for example of a Ni,Zn alloy, on a precathode sheet (that is to say, a sheet of fibers, composite and deposited onto an elementary cathode, this sheet fulfilling in particular the usual function of a cathode) presents the major disadvantage of activating the sheet only at the surface, with its core being unaffected, and this markedly diminishes the advantages to be expected of a three-dimensional electrode; moreover, since the electroactivator is situated at the diaphragm/precathode interface, most of the hydrogen release takes place at this interface and contributes to the breaking up of the assembly. In addition to this, a sheet of this kind can be coupled with a diaphragm only with difficulty, because of the metal layer formed on its surface;

(3) the incorporation of the Ni-Al compound in the form of powder into materials of this type, in order to produce cathode elements does not permit a satisfactory improvement in their performance, as is shown by the comparison of the voltage values (at the electrolyzer terminals) extrapolated to zero intensity ($U_{I\to 0}$), which are obtained without activation and with activation, respectively, and which are reproduced in the last table of said '425 European application.

This same application also proposes a process for the manufacture of these materials, which consists in preparing a suspension comprising the conductive fibers and the binder, and then removing the liquid medium and drying the sheet obtained. The suspension may also contain non-conductive fibers, pore-forming agents and/or catalytic agents.

The sheet may be formed by filtering the suspension through a highly porous material, under programmed vacuum, and can then be dried for 1 to 24 h at a temperature of between 70° and 120° C., and then bonded by heating to a temperature from 5° to 50° C. above the melting or softening point of the fluoropolymer for a period of time which can range from 2 to 60 min.

Finally, this European application also proposes use of the materials discussed above for the production of composite materials by combining said materials with an elementary cathode consisting of a metal surface. Said combination is carried out by filtering the suspension containing the fibers and the fluoropolymer directly through said elementary cathode, followed by melting of the binder.

Furthermore, European Patent Application No. 86/420184.3 (corresponding to U.S. patent application Ser. No. 892,432, filed Aug. 4, 1986), notes the importance of the monodisperse nature of the lengths of the fibers employed, both from the standpoint of the quality of the microporous materials containing electrically conductive fibers, such as carbon or graphite fibers, as well as from the standpoint of producing such materials on an industrial scale by vacuum filtration of a suspension of fibers and binder.

By "monodisperse distribution" is intended a distribution of lengths such that the length of at least 80%, and advantageously 90%, of the fibers corresponds to the mean length of the fibers to within ±20% and, advantageously, to within ±10%.

In a preferred embodiment, the mean length of the fibers is, at most, equal to the diameter of the perforations of the perforated rigid substrate onto which the fibrous sheet is deposited.

European Patent Application No. 86/420237.9 (corresponding to U.S. Pat. No. 4,775,551), notes the importance, both from the standpoint of microporosity and from that of the consolidation of the microporous materials, of using certain derivatives based on silica as an agent for forming the network of binder based on a fluoropolymer latex and, more particularly, when carbon or graphite fibers are to be bonded by means of a polytetrafluoroethylene latex.

Nonetheless, need continues to exist in this art for yet further improved electrode material.

SUMMARY OF THE INVENTION

Accordingly, a major object of the present invention is the provision of electroactivated materials which are improved from the standpoint of their electrocatalytic performance and whose mechanical properties are maintained, or even improved, particularly by the enhanced cohesion of the entire assembly.

Another object of the present invention is the provision of electroactivated composite materials that are porous in structure, which are improved both from the standpoint of their electrical and catalytic performance, as well as from that of their mechanical and/or physical properties.

Another object of this invention is the provision of a process which is more particularly suited to the manufacture of such materials, be they composites as described above, or otherwise.

Briefly, the present invention features an electroactivated material comprising fibers, at least a portion of which are electrically conductive, and a fluoropolymer binder. Such material exhibits a resistivity below 0.4 ohm cm, and is characterized in that it comprises at least one electrocatalytic agent distributed uniformly in its mass, the said agent being selected from among the Raney metals an Raney alloys from which most of the easily removable or fugitive metal(s) has (have) been removed (depleted), and mixtures thereof.

The preferred materials according to the invention are those in which said agent constitutes from 30 to 70% of the weight of the assembly (fibers+binder+electrocatalytic agent).

This invention also features a composite structure formed by the combination of the electroactivated material described above and an elementary cathode including a metal surface and a composite structure formed by the assembly of an electroactivated material, an elementary cathode, both described above, and a diaphragm.

DETAILED DESCRIPTION OF THE PREFERRED EMBODIMENTS OF THE INVENTION

More particularly according to the present invention, the subject electroactivated material is in the form of a sheet, as, for example, defined in European Application No. 0,132,425 (corresponding to U.S. Pat. No. 4,743,349), the thickness of which generally ranging from 0.1 to 5 mm and advantageously from 0.5 to 3 mm and whose surface area may be up to several tens of $m^2$, and which can assume a wide variety of shapes.

The material in question comprises fibers, at least a portion of which are electrically conductive; the selection of the conductive fibers and their optional combination, particularly with nonconductive fibers, are dictated, in particular, by the electrical and mechanical properties required in the consolidated sheet and by considerations related to the availability, cost and/or processability.

By "electrically conductive fibers" is intended any material in the form of a filament whose diameter is generally less than 1 mm and preferably between $10^{-5}$ and 0.1 mm and whose length is greater than 0.5 mm and preferably between 1 and 20 mm, said material exhibiting a resistivity equal to or below 0.4 ohm cm.

Fibers of this kind may consist entirely of an intrinsically electrically conductive material; metal fibers and in particular iron, and ferrous or nickel alloy fibers, and carbon or graphite fibers are examples of such materials. Fibers derived from an electrically nonconductive material but which have been rendered conductive by certain treatments may also be employed; for example, asbestos fibers rendered conductive by chemical or electrochemical deposition of a metal such as nickel, or zirconia ($ZrO_2$) fibers made conductive by nickel-coating. In the case of fibers made conductive by such treatment, the latter will be carried out under conditions such that the fiber resulting therefrom exhibits the above-mentioned resistivity.

It should be noted, nevertheless, that metal fibers are relatively rare and do not always exhibit the mechanical or chemical properties, such as corrosion resistance, which are required for industrial applications. Furthermore, their high relative density makes it difficult to control the homogeneity of a suspension and, consequently, the isotropy of the final material.

Moreover, nonconductive fibers which have been rendered conductive can be altered by heat treatments and by corrosion and, consequently, ultimately exhibit the same defects as the metal fibers just discussed.

Among the conductive fibers, carbon or graphite fibers are preferred, and more particularly those exhibiting a monodisperse length as defined above.

Provided that the maximum resistivity values indicated above are observed, the conductive fibers and, in particular, the carbon or graphite fibers may be combined with electrically nonconductive fibers. These fibers are generally in the form of filaments whose geometric characteristics are similar to those given in the case of the conductive fibers, but whose resistivity will be conventionally greater than 0.4 ohm cm.

The use of nonconductive fibers can satisfy various constraints, both mechanical and economic, determined for the consolidated sheet and/or can facilitate the process for their manufacture.

By way of illustration of nonconductive fibers intended hereby, representative are inorganic fibers such as asbestos fibers, glass fibers, quartz fibers and zirconia fibers, or organic fibers such as polypropylene or, optionally halogenated and especially fluorinated, polyethylene fibers, polyhalovinylidene and especially polyvinylidene fluoride fibers, and also fluoropolymer fibers which will be discussed later in connection with the binder for the sheet material according to the invention.

Asbestos fibers are the preferred, in particular in combination with carbon or graphite fibers.

In a (conductive fibers/nonconductive fibers) combination, the proportion of nonconductive fibers should not exceed 50% by weight, and preferably 30% by weight, in order to ensure, in particular, a satisfactory consolidation of the entire assembly.

The binder for the materials according to the present invention is a fluoropolymer. By "fluoropolymer" is intended a homopolymer or a copolymer at least partly derived from olefinic monomers completely substituted by fluorine atoms or completely substituted by a combination of fluorine atoms and of at least one of chlorine, bromine and iodine atoms per monomer.

Examples of fluoro homo- or copolymers are polymers or copolymers derived from tetrafluoroethylene, hexafluoropropylene, chlorotrifluoroethylene and bromotrifluoroethylene.

Such fluoropolymers may also contain up to 75 mole percent of recurring units derived from other ethylenically unsaturated monomers containing at least as many fluorine atoms as carbon atoms, such as, for example, vinylidene (di)fluoride, and vinyl perfluoroalkyl ethers, such as perfluoroalkoxyethylene.

Several fluoro homo- or copolymers as defined above may obviously be employed in the invention. It is also within the ambit of this invention to combine with these fluoropolymers a small quantity, for example up to 10 or 15% by weight, of polymers whose macromolecule does not contain fluorine atoms, such as, for example, polypropylene.

The fluoropolymer employed as binder for a combination of fibers and of electrocatalytic agent ma be present in the material in question in quantities which can vary over wide limits, account being taken of the content of fibers and of electrocatalytic agent, or even of the nature of the various constituents of said material.

However, in order to ensure good consolidation of the entirety, the binder will preferably constitute from 20 to 50% by weight in the subassembly (fibers+-binder).

The electroactivated material according to the invention also comprises an electrocatalytic agent distributed uniformly therethrough, said agent being selected from among the Raney metals and Raney alloys from which most of the easily removable or fugitive metal(s) has (have) been depleted or removed, and mixtures thereof.

By "Raney (or Raney-type) metal" are intended the special, high surface area, catalytic forms of the following metals: nickel, cobalt, iron and copper, optionally doped or stabilized with at least one of the metals; chromium, cobalt, titanium, molybdenum, tungsten, vanadium and manganese.

Nevertheless, without, however, wishing to be limited or bound by the following explanations, it has been found that this agent, referred to above as a Raney metal, is capable of being converted both from a chemical and a physical standpoint as a consequence of the treatments to which it is subjected during the preparation of the material and/or when it is used.

These special, high surface area, catalytic forms are generally obtained, in a manner known per se, from an alloy containing one or more of these catalytically active metals and one or more easily removable metals such as aluminum, silicon, magnesium and zinc; the said catalytically active metal being present in a "dissolved" state in the easily removable metal. The initial alloy (or precursor) may also contain minor quantities, generally not exceeding 5% by weight of said active metal(s), of one or more stabilizing or dopant metals selected from among chromium, cobalt, titanium, molybdenum, tungsten, vanadium and manganese. When a precursor of this type is washed with alkali, most of the easily removable metal(s) is (are) removed. It will be appreciated that by the expression "Raney alloys from which most of the easily removable (or fugitive) metal(s) has (have) been removed (or depleted)" within the scope of the present invention, are intended "precursor" alloys which have just been discussed, but which have been treated with a view to removing therefrom most of the easily removable metal(s). Nevertheless, after treatment, these alloys may still contain up to 20% by weight of these easily removable metals.

The following references are representative of the general knowledge on the subject and especially with regard to the various preparations discussed above:

*Chemical Technology Review No.* 94, "Hydrogenation Catalysts", R. J. Peterson; Noyes Data Corp. 1977, "Preparation of Nickel Hydrogenation Catalyst", pp. 3–10.

R. L. Augustine, *Catalytic Hydrogenation,* Marcel Dekker Inc., NY (1965), pp. 26–32, and appendices pp. 147–149.

A first class of electroactivated materials according to the invention, the preferred, comprises Raney nickel.

A second class of electroactivated materials according to the invention, also preferred, comprises an alloy of nickel and aluminum optionally doped with titanium. In the precursor alloys, nickel represents from 30 to 60% by weight, and the dopant from 0 to 5% by weight, the remainder being aluminum, and the identified phases are chiefly $Ni_2Al_3$ and $NiAl_3$; the presence of the NiAl phase must be kept to a minimum because it can be attacked by alkaline solutions only with difficulty and it results in an unsatisfactory electroactivation of the material.

To a greater or lesser extent depending on the individual constitution, these nickel-containing materials exhibit the additional advantage of very appreciably reducing the chlorate content of the sodium hydroxide produced by electrolysis of a sodium chloride solution when they constitute a precathodic layer of the cathode element in the electrolysis cell.

As indicated above, the electrocatalytic agent advantageously represents from 30 to 70% by weight and, preferably, at least 35% by weight of the entire assembly (fibers+binder+electrocatalytic agent).

An essential characteristic of the subject material is in the homogeneous distribution of the electrocatalytic agent(s) in its mass; to a large extent, this homogeneous distribution plays a role in imparting good electrical and electrocatalytic properties to the material.

This homogeneous distribution may be ensured by various techniques, among which are representative:

(a) resorting to electrocatalytic agents or to their precursors which are in the form of powders of an appropriate particle size;

(b) predispersion of the various constituents of the material in a gaseous medium in a fluidized bed, followed by deposition onto a surface;

(c) dispersion of all constituents in a liquid medium in the presence of agents which control the viscosity and/or the relative density of the medium, to obtain a uniform dispersion which is stable over time and a homogeneous deposit by various techniques, such as filtration.

The materials according to the present invention have been defined by their essential constituents, namely, the fibers, the binder and the electrocatalytic agent. It is apparent that at some stage or other of their development, or in order more particularly to meet the additional requirements linked especially with their ultimate end use, these materials may contain various other additives, present simultaneously or capable of succeeding each other in the various stages of preparation of the subject materials.

Thus, the materials according to the present invention may also contain hydrophilic agents.

The use of such agents is especially recommended when the sheet is to be employed in an aqueous medium such as, for example, in a process for the electrolysis of aqueous sodium chloride solutions. The hydrophilic agent improves the wettability of the sheet of fibers by counterbalancing, as it were, the strongly hydrophobic nature of the fluoropolymers.

The hydrophilic agents may be selected from among various groups of products. As a general rule, they may be liquid or pulverulent products, of an organic or inorganic nature. By way of examples of such agents, surface-active agents or surfactants are representative, such as sodium dioctylsulfosuccinate, etc., or inorganic compounds such as asbestos in the form of powder or short fibers, zirconia, cerium dioxide, potassium titanate, and hydrated oxides and especially alumina.

The quantity of hydrophilic agent which may be present in the sheets according to the invention obviously depends on the use for which the sheet is intended, on the quantity of hydrophobic product (essentially the fluoro binder, but also certain fibers present in these sheets) and on the nature of the hydrophilic agent. To provide an order of magnitude, it may be indicated that the quantity of hydrophflic agent may be up to 10% of the weight of the fluoro binder and, more specifically, from 0.1 to 5% of the weight of the said binder.

The materials may also contain pore-forming agents to regulate their porosity, a porosity which, assuming an application in electrolysis, affects the flow of liquids and the removal of gases. It must be appreciated that when such pore-forming agents are present, the final material whose porosity will have been regulated or modified under the effect of decomposition or removal of these agents, will in principle no longer contain any such agents. By way of illustration of the pore-forming agents, inorganic salts are exemplary which can subsequently be removed by leaching, and salts which can be removed by chemical or thermal decomposition.

These various products may also be selected from among alkali metal or alkaline-earth metal salts such as halides, sulfates, sulfinates, bisulfites, phosphates, carbonates and bicarbonates. Amphoteric alumina and, above all, silica, which can be removed in an alkaline medium, are also representative.

It too will be appreciated that the quantity and the particle size of the pore-forming agents—when such agents are employed—is closely linked with the application for which the materials are intended. Merely to indicate the order of magnitude, it will be explained that the particle size of the pore-forming agents varies in most cases between 1 and 50 μm, and that the quantity is selected depending on the desired porosity, it being possible for this porosity to be up to 90%, or even higher (according to ASTM standard D 276-72).

The present invention also features a composite material formed by the combination of at least one electroactivated material defined previously and an elementary cathode including a metal surface. By "elementary cathode" is intended a metal structure which is generally made of iron or of nickel, essentially consisting of a grid or a piece of perforated metal and acting as a cathode in an electrolysis cell. This elementary cathode may be made of one or of an assembly of planar surfaces or, in the case of electrolysis cells of the "glove finger" type, may be in the form of a cylinder whose directrix is a more or less complex surface, generally substantially rectangular with rounded angles.

The combination of a material of this kind and of an elementary cathode may be carried out by various methods, as discussed below.

The composite material resulting from this combination constitutes, in fact, the actual cathode of an electrolysis cell, such application in the production of a cathode element of an electrolysis cell constituting the particularly advantageous, though not exclusive, field of use for the electroactivated materials according to the invention. Assuming such an application, it is possible, according to conventional practice, to employ a membrane or a diaphragm in the cell between the anode and cathode compartments. In the case of a membrane, which may be selected from among the many electrolysis membranes described in the literature, the composite element according to the invention constitutes an outstanding mechanical support and ensures a remarkable current distribution. This current distribution is naturally related to the special structure of the composite elements in accordance with the invention.

Notwithstanding the voltage gain which can already be observed due to the presence of conductive fibers, an additional gain in voltage is obtained because of the presence, within the material, of the special electrocatalytic agents distributed homogeneously in the mass of the material.

The composite material resulting from the combination of an electroactivated material and of an elementary cathode, described above, may also be combined with a diaphragm.

This diaphragm, which may be selected from among the many electrolysis diaphragms which are now known, may be manufactured separately. It may also be manufactured directly on the electroactivated material or on the electroactivated material/elementary cathode composite, and this constitutes another preferred embodiment of the invention. This direct manufacture is particularly straightforward when the diaphragm is manufactured by filtering a suspension. These techniques for the manufacture of porous and microporous membranes or diaphragms are described, for example, in French Patents Nos. 2,229,739, 2,280,435 or 2,280,609 and French Patent Applications Nos. 81/9,688 and 85/14,327, hereby incorporated by reference.

The composite materials comprising, from one face to the other, the elementary cathode, the electroactivated material bonded by means of the fluoropolymer and the porous or microporous membrane or diaphragm, form coherent assemblies having the benefit of all the advantages of the electroactivated material and the electroactivated material/elementary cathode composite, to which is added the considerable advantage of dispensing with the traditional diaphragm/cathode interface and with its detrimental effects, namely, an interfering electrical resistance drop in the gas-liquid emulsion close to the cathode substrate.

As indicated above, the electroactivated materials according to the present invention may be prepared according to various known methods (use of a fluidized bed, followed by the deposition onto one surface and by consolidation; preparation of a sheet by a papermaking technique, followed by its consolidation, etc.), or adaptations of such methods, which would be apparent to one skilled in this art.

However, a wet route is the preferred and this constitutes another object of the present invention. This process, more particularly suitable for the preparation of a material to be consolidated onto a cathode of complex geometry employed in industry, comprises the following stages:

(a) the preparation, in an aqueous medium, of a dispersion comprising the fibers, the binder, the electrocatalytic agent or one of its precursors and, where appropriate, additives;

(b) the deposition of a sheet by filtration, under programmed vacuum, of the said suspension through a material of high porosity;

(c) the removal of the liquid medium and the drying of the sheet thus formed; and (d) where appropriate, sintering of the sheet, followed by the removal of the easily removable metal(s) by leaching the sheet with a solution which does not attack the electroactive part of the precursor alloy.

Advantageously, a small quantity of a thickening agent selected, for example, from among the natural or synthetic polysaccharides, is incorporated into the aqueous medium.

The dispersion will obviously contain all the essential constituents of the sheet, it being possible for the electrocatalytic agent to be present in the dispersion in the form of a precursor alloy, as described above and, where appropriate, various additives such as nonconductive fibers, hydrophilic agents, pore-forming agents and dispersing agents or surface-active agents, especially sulfonic anionic surfactants which are widely employed in practice.

The electrocatalytic agent or its precursor will be introduced in the form of a powder with a particle size which is generally below 500 μm. The commercial products are generally in the form of a powder of this kind in a liquid, generally aqueous, medium. These products may be added as such to the dispersion used to form the sheet.

Assuming that products of a much coarser particle size are employed, these will have to be ground beforehand.

The fluoropolymer is generally in the form of a dry powder or of fibers or of an aqueous dispersion (latex) whose solids content is from 30 to 70%.

As is well known to this art, the suspension in question is generally highly diluted, the solids content (fibers, polymer, electrocatalytic agent and additives) represents on the order of 1 to 5% of the weight of the entirety, in order to make it easier to handle on an industrial scale.

The sheet is then formed by programmed vacuum filtration of the suspension through a high-porosity material such as metal grids made, for example, of iron, or cloths made, for example, of asbestos, whose mesh opening (or perforations) may be between 20 μm and 5 mm. The vacuum program may be continuous and/or stepwise, from atmospheric pressure to the final vacuum ($1.5\times110^{-3}$ to $4\times10^{-4}$ Pa).

The sheet thus formed may be dried in a manner which is known per se, and, where appropriate, consolidated by heating, known per se, to a temperature above the melting or softening point of the fluoropolymer.

Assuming that the intention is only to obtain the sheet thus formed, this consolidation will have to be carried out and, assuming that a precursor alloy, as defined above, has been employed in the manufacture of the said sheet, the consolidation will need to be followed by the removal of the easily removable metal(s) by leaching the sheet with a solution which does not attack the electroactive part of the alloy. Thus, for example, the removal of most of the aluminum present in a nickel-based precursor alloy may be advantageously carried out by treatment for approximately 30 min to 6 h at a temperature of between 60° and 100° C. using an aqueous sodium hydroxide solution whose concentration will be between 100 and 180 g/l.

Insofar as the combination of the sheet formed by filtration as indicated above and of a diaphragm is concerned, it is preferred that the combination be produced by filtering through the optionally consolidated sheet a suspension of the constituents necessary for the manufacture of the diaphragm in a suitable liquid medium, followed by consolidation of the diaphragm or of the whole.

When the binder for the diaphragm is the same kind as the binder for the sheet, the intermediate consolidation of the sheet may become superfluous, and the consolidation may then be carried out on the entire assembly.

This consolidation can then be followed by an appropriate treatment in order to remove the pore-forming material present in the deposited diaphragm: when the sheet contains a Raney metal such as Raney nickel, and when the deposited diaphragm contains silica, the consolidation is conducted on the whole and the treatment with an aqueous sodium hydroxide solution, described above, is applied to the consolidated unit in order to remove the silica present in the diaphragm. When the sheet contains a precursor alloy, such as an alloy of nickel and aluminum and, when the deposited diaphragm contains silica, the consolidation may be done separately in the case of the sheet and, where appropriate, followed by the treatment with an aqueous sodium hydroxide solution with a view to removing the aluminum. The diaphragm will then be deposited and then consolidated and treated to remove the silica. It will be possible for the consolidation to be advantageously performed on the whole and then to be followed by a single treatment with the aqueous sodium hydroxide solution to remove both aluminum from the sheet and silica from the diaphragm.

When the binder for the diaphragm is of a different kind from that for the sheet, each member of the combination must be consolidated separately and, if necessary, the removal of the easily removable metal(s) must be carried out after consolidation of the sheet, whether the diaphragm is deposited beforehand or not.

It will be appreciated that a sheet obtained by filtration and consolidated as indicated above, and which contains a precursor alloy such as an alloy of nickel and aluminum may advantageously be combined with a diaphragm by filtering a suspension of the constituents of the diaphragm whose binder is dispersible in the liquid medium capable of removing, for example, aluminum, without attacking the nickel in the present case, since the diaphragm deposition operation by itself enables most of the aluminum present in the consolidated sheet to be removed.

Such, for example, is the possibility presented by the deposition of a diaphragm whose essential constituents (asbestos fibers, polychlorotetrafluoroethylene powder) are dispersible in an aqueous sodium hydroxide solution containing sodium chloride, where appropriate.

In order to further illustrate the present invention and the advantages thereof, the following specific examples are given, it being understood that same are intended only as illustrative and in nowise limitative.

EXAMPLES

Preparation A

Preparation of materials, electroactivated where appropriate, employed as precathodic sheets:

A suspension was prepared from:

(i) 932 g of softened water;

(ii) 4 g of chrysotile asbestos fibers, the mean length of which ranged from 1 to 5 mm and whose diameter was approximately 200 angstroms;

(iii) 0.13 g of sodium dioctylsulfosuccinate.

After rotary stirring for 30 min, the following were added:

(iv) 4.7 g of polytetrafluoroethylene in the form of a latex with a solids content of 60% by weight;

(v) 13.4 g of precipitated silica in the form of particles with a mean particle size of 3 μm and whose B.E.T. surface area was 250 $m^2 g^{-1}$;

(vi) 9.4 g of graphite fibers whose diameter was approximately 10 μm and whose mean length was 1.5 mm. After rotary stirring for 30 min, the electroactivating agent was added or, where appropriate, one of its precursors, the nature and quantity of which will be specified in the following examples and the appended table.

The entire mass was then stirred, and 110 g of the mixture thus obtained were then deposited by filtration onto a 1 $dm^2$ cathode element consisting of a plaited and rolled iron grid whose openings were 2 mm and in which the wire diameter was 2 mm.

The filtration was carried out under a vacuum which was programmed as follows:

1000 Pa $min^{-1}$ for 10 min;

5000 Pa $min^{-1}$ to provide a final reduced pressure of 25,000 Pa.

The entirety was then dried for 12 h at 100° C. and then, where appropriate, consolidated by melting the fluoropolymer for 7 min at 350° C. (This separate preliminary consolidation was not necessary, assuming that the precathodic element was combined with a diaphragm in which the binder was the same as that in the sheet.)

Preparation B

Preparation of an aqueous dispersion of fibers for producing a microporous diaphragm and production of a composite material comprising a precathodic sheet and a diaphragm of such type A suspension was prepared from:

(i) 953 g of softened water;

(ii) 14.5 g of chrysotile asbestos fibers with a diameter of 200 Å and less than 1 mm in length;

(iii) 14.5 g of chrysotile asbestos fibers with a diameter of 200 Å and with a mean length of between 1 and 5 mm;

(iv) 0.29 g of sodium dioctylsulfosuccinate.

After rotary stirring for 30 min, the following were added:

(v) 5.8 g of polytetrafluoroethylene in the form of a latex with a solids content of 60% by weight;

(vi) 7.25 g of precipitated silica in the form of particles with a mean particle size of 3 μm and whose B.E.T. surface area is 250 $m^2 g^{-1}$.

The entire mass was then stirred for 30 min and after 48 h at rest, the suspension was then stirred again and 350 g of this mixture were filtered through 1 $dm^2$ of a dried but unconsolidated precathodic sheet, or through 1 $dm^2$ of asbestos cloth. The filtration was carried out at a programmed vacuum of 5000 Pa $min^{-1}$, to attain 80,000 Pa.

The composite thus obtained was dried for 12 h at 100° C. and was consolidated by melting the fluoropolymer for 7 min at 350° C.

Preparation C

Preparation of an aqueous dispersion of asbestos fibers to produce a diaphragm and production of a composite material from a precathodic sheet and a diaphragm:

A suspension was prepared from:

(i) 978 g of an aqueous solution containing 140 g $l^{-1}$ of sodium hydroxide and 160 g $l^{-1}$ of sodium chloride;

(ii) 20 g of chrysotile asbestos fibers with a diameter of 200 Å and 1 to 5 mm mean length;

(iii) 0.11 g of isooctylphenoxypolyethoxyethanol;

(iv) 1.6 g of polychlorotrifluoroethylene in the form of powder with a mean particle size of 50 μm (PCTFE).

The mixture was stirred by air injection for 30 min. 500 g of this suspension were filtered through 1 $dm^2$ of a preconsolidated precathodic sheet.

The composite obtained was dried for 12 h at 100° C. and the consolidation of the diaphragm was carried out by melting the polymer (PCTFE) for 30 min at 260° C.

EXAMPLE 1

Production of a composite material comprising a precathodic sheet electroactivated with Raney nickel and a microporous diaphragm Using the operating procedure A, described above, a precathodic sheet was prepared, containing 3.5 g of an alloy of nickel and aluminum (Raney 20 alloy marketed by Procatalyse, containing 50 parts by weight of nickel per 50 parts by weight of aluminum), said alloy having been added to the suspension in the form of a powder whose mean particle size was 20 μm.

The sheet thus prepared and consolidated was then treated for 4 h at 80° C. with an aqueous solution containing 140 g $l^{-1}$ of sodium hydroxide, an operation which was conducted to remove the aluminum.

This sheet was then carefully rinsed with softened water and was covered with a microporous diaphragm prepared separately according to the operating procedure B, by filtration through 1 $dm^2$ of asbestos cloth.

Most of the silica was removed by alkaline digestion under the conditions described previously in the case of the treatment of the sheet.

Control test a:

Production of a composite material not in accordance with the present invention.

Example 1 above was repeated, but omitting the treatment of the consolidated sheet with the aqueous sodium hydroxide solution, and covering it with a microporous diaphragm similar to that above, except that the removal of the silica by an alkaline treatment was carried out before deposition of the said diaphragm onto the precathodic element.

Control test b:

A precathodic sheet devoid of electroactivator was prepared according to (A) and was then covered with an asbestos/PCTFE diaphragm obtained according to (C).

Control test c: (Absence of precathodic element)

A plaited and rolled steel grid was covered with an asbestos/PCTFE diaphragm by preparing a suspension in which 50% of the chrysotile asbestos fibers with a length of 1 to 5 mm had been replaced with fibers of a length of between 5 and 20 mm. (This device is typical of the current practices in the chlorine industry).

EXAMPLE 2

Production of a composite material comprising a precathodic sheet, said sheet containing a Raney alloy based on nickel and aluminum, and a diaphragm based on asbestos fibers and PCTFE, the removal of most of the aluminum being carried out during the deposition of the diaphragm.

According to the operating procedure A, described above, a precathodic sheet was prepared, containing 3.5 g of an alloy of nickel and aluminum (Raney 20 alloy marketed by Procatalyse, containing 50 parts by weight of nickel per 50 parts by weight of aluminum), said alloy having been added to the suspension in the form of a powder whose mean particle size was 20 μm.

The sheet thus prepared was consolidated. 500 g of the suspension prepared according to the operating procedure C, above, were then filtered through 1 $dm^2$ of this sheet. The composite was then dried and the diaphragm was consolidated as indicated in preparation C.

EXAMPLE 3

Example 2 above was repeated, with the method of depositing the diaphragm being modified in that it was carried out with a controlled vacuum program of 1,000 Pa $min^{-1}$ to attain a final vacuum of 80,000 pa.

EXAMPLE 4

Production of a composite material comprising a precathodic sheet electroactivated with Raney nickel and a diaphragm based on asbestos fibers and PCTFE.

A precathodic sheet containing 2 g of Raney nickel in the form of 10 μm powder (Ni 20 marketed by Procatalyse in the form of a powder stored in water) was prepared according to the operating procedure (A) and consolidated.

It was covered with an asbestos/PTCFE diaphragm such as that prepared in C.

EXAMPLE 5

Production of a composite material comprising a precathodic sheet, said sheet containing a Raney alloy based on nickel and aluminum, and a diaphragm based on asbestos fibers and PTFE, the sintering and the consolidation of the assembly being performed in one operation, the removal of the aluminum from the sheet and of the silica from the diaphragm being carried out in one alkaline digestion operation.

The precathodic sheet containing 3.5 g of the above-mentioned alloy was prepared according to the operating procedure A; after drying, it was covered with a diaphragm such as described in B. The assembly was consolidated and was then subjected to an alkaline digestion with an aqueous solution of sodium hydroxide at a concentration of 140 g $l^{-1}$ at 60° C. for 4 h. The face where the steel grid was visible was maintained at reduced pressure (between 400 and 20,000 Pa) relative to the face of the diaphragm. The operation was carried out on a 1 $dm^2$ of composite.

The permeability increased steadily during the operation.

EXAMPLES 6 to 8

Production of composite materials comprising a precathodic sheet electroactivated with Raney nickel and an asbestos/PTFE diaphragm.

In each example, a sheet was prepared, containing pyrophoric Raney nickel in the form of 10 μm powder (Ni 20 from Procatalyse) according to the operating procedure A, and it was then covered with a diaphragm such as that described in B. The assembly was consolidated and the silica was removed by alkaline digestion.

EXAMPLES 9 to 11

These examples are similar to Examples 6 to 8 above, respectively, except that deactivated Raney nickel was employed, in the form of 50 μm powder (NiPS2 from Doduco marketed by Procatalyse).

EXAMPLES 12 to 14

These examples are similar to Examples 6 to 8 above, respectively, except that titanium-doped Raney nickel was employed, this agent being prepared from an alloy of nickel, aluminum and titanium by alkaline digestion, as described in *J. of the Electrochemical Society*, "Electrochemical Science and Technology", Vol. 124, No. 1, p. 1 (1977). This alloy contained 5% by weight of titanium and equal weight quantities of aluminum and nickel. After grinding, aluminum was removed from it and it was then employed in the manufacture of sheets according to the operating procedure A.

The performance of the various composite materials, the manufacture of which is described above, was then evaluated in an electrolysis cell which had the following characteristics and whose operating conditions are indicated below:

Expanded, rolled titanium anode coated with $TiO_2$—$RuO_2$;

Plaited and rolled mild steel cathode element; 2-mm wires, 2-mm mesh or the said element covered with the sheet;

Anode-cathode element distance 6 mm;

Active surface area of the electrolyses : 0.5 $dm^2$;

Cell assembled according to the filter-press type;

Current density: 25 A $dm^{-2}$;

Temperature: 85° C.;

Operation at constant anode chloride: 4.8 mole $l^{-1}$;

Concentration of the sodium hydroxide electrolyte: 180 g $l^{-1}$.

The individual conditions and the results obtained are reported in Table I below, in which the following conventions are employed:

| | |
|---|---|
| $\Delta U_{i\to 0}$: | extrapolated voltage at zero intensity (by plotting the curve $\Delta U = f(I)$). |
| $\Delta U_{25}$: | voltage at the terminals of the electrolyzer at 25 A $dm^{-2}$. |
| FE: | Faraday efficiency. |
| EC: | energy consumption of the system in kilowatt hours per ton of chlorine produced. |
| $(ClO^-{}_3)_a$: | $ClO^-{}_3$ concentration in the anolyte (mole $l^{-1}$). |
| $(ClO^-{}_3)_c$: | $ClO^-{}_3$ concentration in the sodium hydroxide electrolyte. |
| D.R. (%): | degree of reduction of the anode chlorates, that is the ratio $\frac{(ClO^-{}_3)_a - (ClO^-{}_3)_c}{(ClO^-{}_3)_a \times 100}$ |
| M: | mass deposited, in g $dm^{-2}$. |

The nature of the agent employed in the preparation of the sheet means the Raney metal or the precursor alloy placed in suspension and the precise quantity means that placed in suspension during the preparation according to (A).

The nature of the diaphragm means the type of preparation B or C of the latter.

The results which are reported in Table I which follows show that at identical sodium hydroxide concentration and for an equivalent weight of deposited diaphragm, no significant differences appear in the Faraday efficiencies.

They also show that the composite material produced by the combination using direct deposition of a diaphragm onto an electroactivated precathodic sheet according to the invention offers improved performance in the field of electrolysis and especially a lower energy consumption and a reduction in the chlorate content.

The extrapolated voltages at zero intensity reveal, in particular, the importance of the removal of aluminum when a precursor alloy is employed.

Furthermore, the performances shown were maintained after 3000 hours of operation.

EXAMPLES 15 and 16

Control test d

The performance of the composite materials whose preparation has been described in Examples 5 and 7 and in control test b above, respectively, was evaluated in an electrolysis cell similar to that described above, except that its anode consisted of expanded and rolled titanium coated with a 0.7 μm thick layer consisting of 75% by weight of platinum and 25% by weight of iridium.

The electrolysis conditions are otherwise unchanged. The results obtained are reported in Table II below.

TABLE II

| Example No. | Material described in Example No. | RESULTS $\Delta U_{i\to o}$ volts | $\Delta U_{25}$ volts | FE (%) | EC kWh/T(Cl2) | D.R. (%) | $(ClO^-{}_3)_a$ mol $l^{-1}$ |
|---|---|---|---|---|---|---|---|
| 15 | 5 | 2.20 | 3.15 | 94 | 2,533 | 90 | $20 \cdot 10^{-3}$ |
| 16 | 7 | 2.21 | 3.20 | 94 | 2,574 | 80 | $20 \cdot 10^{-3}$ |
| d | b | 2.34 | 3.45 | 93 | 2,805 | 40 | $25 \cdot 10^{-3}$ |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. An electroactivated shaped article, which comprises a mass of fibrous material consolidated in a matrix of fluoropolymer binder, at least a portion of the fibers comprising said fibrous material being electrically conductive, said shaped article having a resistivity of less than 0.4 ohm cm and having at least one electrocatalytically active agent uniformly distributed therethrough, and said electrocatalytically active agent comprising at

TABLE I

| Example No. | PRECATHODIC SHEET Preparation (A) Nature of the agent | Quantity | Comment | COMBINATION (sheet diaphragm) Precathode M(g/dm2) | Diaphragm Nature | Diaphragm M(g/dm2) |
|---|---|---|---|---|---|---|
| 1 | Raney 20 alloy | 3.5 | With alkaline treatment | 7.04 | B | 12.0 |
| a | Raney 20 alloy | 3.5 | Without alkaline treatment | 7.04 | B | 12.0 |
| b | — | 0 | Without electroactive agent | 3.5 | C | 14.5 |
| c | — | — | No precathodic sheet | None | C | 17.5 |
| 2 | Raney 20 alloy | 3.5 | Treatment during the deposition of a diaphragm according to C | 7.04 | C | 15.0 |
| 3 | Raney 20 alloy | 3.5 | Treatment during the deposition of a diaphragm according to C (Different vacuum program during the deposition of the diaphragm) | 7.04 | C | 15.0 |
| 4 | Ni 20 | 2 | None | 5.5 | C | 15.0 |
| 5 | Raney 20 alloy | 3.5 | Treatment after deposition of a diaphragm according to B | 7.04 | B | 14.5 |
| 6 | Ni 20 | 1.2 | None | 4.8 | B | 14.5 |
| 7 | Ni 20 | 2.0 | None | 5.5 | B | 14.5 |
| 8 | Ni 20 | 3.4 | None | 7.0 | B | 14.5 |
| 9 | Ni P S2 | 1.2 | None | 4.8 | B | 14.5 |
| 10 | Ni P S2 | 2.0 | None | 5.5 | B | 14.5 |
| 11 | Ni P S2 | 3.4 | None | 7.0 | B | 14.5 |
| 12 | Ti-doped Ni | 1.2 | None | 4.8 | B | 14.5 |
| 13 | Ti-doped Ni | 2.0 | None | 5.5 | B | 14.5 |
| 14 | Ti-doped Ni | 3.4 | None | 7.0 | B | 14.5 |

| Example No. | RESULTS $\Delta U_{i\to o}$ volts | $\Delta U_{25}$ volts | FE (%) | EC kWh/T(Cl2) | D.R. (%) | $(ClO^-{}_3)_a$ mol $l^{-1}$ |
|---|---|---|---|---|---|---|
| 1 | 2.19 | 3.20 | 94 | 2,574 | 90 | $2.0 \cdot 10^{-3}$ |
| a | 2.28 | 3.40 | 93 | 2,764 | 70 | $2.2 \cdot 10^{-3}$ |
| b | 2.34 | 3.45 | 93 | 2,805 | 40 | $4.5 \cdot 10^{-3}$ |
| c | 2.34 | 3.60 | 92 | 2,751 | 45 | $5.0 \cdot 10^{-3}$ |
| 2 | 2.23 | 3.30 | 93 | 2,683 | 80 | $2.0 \cdot 10^{-3}$ |
| 3 | 2.21 | 3.20 | 93 | 2,600 | 90 | $2.0 \cdot 10^{-3}$ |
| 4 | 2.21 | 3.15 | 93 | 2,600 | 70 | $2.0 \cdot 10^{-3}$ |
| 5 | 2.20 | 3.15 | 94 | 2,533 | 90 | $1.9 \cdot 10^{-3}$ |
| 6 | 2.24 | 3.30 | 94 | 2,654 | 65 | $2.0 \cdot 10^{-3}$ |
| 7 | 2.21 | 3.20 | 94 | 2,574 | 75 | $2.0 \cdot 10^{-3}$ |
| 8 | 2.21 | 3.15 | 94 | 2,533 | 80 | $2.0 \cdot 10^{-3}$ |
| 9 | 2.27 | 3.45 | 93 | 2,805 | 60 | $2.5 \cdot 10^{-3}$ |
| 10 | 2.25 | 3.40 | 92 | 2,794 | 65 | $3.0 \cdot 10^{-3}$ |
| 11 | 2.22 | 3.30 | 93 | 2,683 | 70 | $2.5 \cdot 10^{-3}$ |
| 12 | 2.23 | 3.30 | 94 | 2,654 | 65 | $2.0 \cdot 10^{-3}$ |
| 13 | 2.21 | 3.20 | 94 | 2,574 | 75 | $2.0 \cdot 10^{-3}$ |
| 14 | 2.20 | 3.15 | 94 | 2,533 | 80 | $2.0 \cdot 10^{-3}$ |

least one Raney metal, or Raney alloy depleted in fugitive metal values.

2. The electroactivated shaped article as defined by claim 1, comprising from 30 to 70% by weight of said electrocatalytically active agent, based on the total weight of fibers+binder+electrocatalytically active agent.

3. The electroactivated shaped article as defined by claim 1, wherein the combination fibers+binder+electrocatalytically active agent, the binder constitutes from 5 to 20% by weight and the fibers from 10 to 65% by weight, with the proviso that the proportion by weight of binder in the subcombination fibers+binder ranges from 20 to 50%.

4. The electroactivated shaped article as defined by claim 1, comprising a sheet material having a thickness ranging from 0.5 to 3 mm.

5. The electroactivated shaped article as defined by claim 1, said electrically conductive fibers comprising monodisperse carbon or graphite fibers.

6. The electroactivated shaped article as defined by claim 1, further comprising up to 50% by weight of electrically nonconductive fibers, based on the weight of said electrically conductive fibers.

7. The electroactivated shaped article as defined by claim 1, further comprising up to 30% by weight of electrically nonconductive fibers, based on the weight of said electrically conductive fibers.

8. The electroactivated shaped article as defined by claim 1, said electrocatalytically active agent comprising Raney nickel, or a Raney nickel alloy depleted in fugitive metal values.

9. The electroactivated shaped article as defined by claim 1, said electrocatalytically active agent comprising a Raney alloy containing not more than 20% by weight of residual fugitive metal values.

10. The electroactivated shaped article as defined by claim 1, comprising a porous composite.

11. The electroactivated shaped article as defined by claim 1, comprising a cathode assembly.

12. A composite structure comprising the electroactivated shaped article as defined by claim 1 and an elementary cathode.

13. A laminate comprising the electroactivated shaped article as defined by claim 1, having an elementary cathode on one face surface thereof and a diaphragm on another face surface.

14. The laminate as defined by claim 13, said diaphragm comprising asbestos fibers in a matrix of fluoropolymer binder and having controlled porosity.

15. The laminate as defined by claim 14 said fluoropolymer binder comprising polychlorofluoroethylene.

16. A process for the production of the shaped article as defined by claim 15, comprising:

(a) preparing, in an aqueous medium, a dispersion comprising the fibers, the binder, and the electrocatalytically active agent or precursor thereof;

(b) forming a sheet by filtration, under programmed vacuum, of said suspension through an elementary cathode including a metal surface having mesh openings ranging from 20 μm to 5 mm;

(c) removing the liquid medium and drying the sheet thus formed;

(d) sintering the sheet thus obtained;

(e) filtering through the sheet a dispersion, in an aqueous sodium hydroxide solution, comprising asbestos fibers and polychlorotrifluoroethylene; and (f) sintering the diaphragm thus formed.

17. A process for the production of the shaped article as defined by claim 14, comprising:

(a) preparing, in an aqueous medium, a dispersion comprising the fibers, the binder, and the electrocatalytically active agent or precursor thereof;

(b) forming a sheet by filtration, under programmed vacuum, of said suspension through an elementary cathode including a metal surface having mesh openings ranging from 20 μm to 5 mm;

(c) removing the liquid medium and drying the sheet thus formed;

(d) filtering through the sheet an aqueous dispersion comprising asbestos fibers, a fluoropolymer and silica;

(e) removing the liquid medium and drying of the diaphragm thus formed;

(f) consolidating the resulting assembly; and (g) treating said consolidated assembly with an aqueous sodium hydroxide solution.

18. The electroactivated shaped article as defined by claim 1, further comprising a pore-forming agent.

19. The electroactivated shaped article as defined by claim 1, further comprising up to 10% by weight, based on the weight of said binder, of a hydrophilic material.

20. The electroactivated shaped article as defined by claim 1, said electrocatalytically active agent comprising a Raney alloy depleted in at least one member selected from the group consisting of aluminum, silicon, magnesium and zinc values.

21. In an electrolytic cell, the improvement which comprises, as the cathode element therefor, the electroactivated shaped article as defined by claim 1.

22. A process for the production of the electroactivated shaped article as defined by claim 1 in sheet material form, comprising:

(a) preparing, in an aqueous medium, a dispersion comprising the fibers, the binder, and the electrocatalytically active agent or precursor thereof;

(b) forming a sheet by filtration, under programmed vacuum, of said suspension through a material of high porosity;

(c) optionally sintering said sheet, and then removing the fugitive metal values by leaching the sheet with a solution which does not attack the electroactive fraction of the precursor alloy.

* * * * *